US008282806B2

(12) United States Patent
Fuhrmann

(10) Patent No.: US 8,282,806 B2
(45) Date of Patent: Oct. 9, 2012

(54) GALVANIC BATH AND PROCESS FOR DEPOSITING ZINC-BASED LAYERS

(75) Inventor: Axel Fuhrmann, Neuss (DE)

(73) Assignee: Enthone Inc., West Haven, CT (US)

( * ) Notice: Subject to any disclaimer, the term of this patent is extended or adjusted under 35 U.S.C. 154(b) by 357 days.

(21) Appl. No.: 12/617,202

(22) Filed: Nov. 12, 2009

(65) Prior Publication Data

US 2010/0116677 A1 May 13, 2010

(30) Foreign Application Priority Data

Nov. 11, 2008 (DE) ..... 10 2008 056 776

(51) Int. Cl.

| | |
|---|---|
| ***C25D 21/06*** | (2006.01) |
| ***C25D 21/18*** | (2006.01) |
| ***C25D 3/56*** | (2006.01) |
| ***C25D 3/22*** | (2006.01) |

(52) U.S. Cl. ..... 205/98; 205/99; 205/101; 205/244; 205/245; 205/246; 205/305

(58) Field of Classification Search ..... 205/98, 205/99, 101, 244, 245, 246, 305
See application file for complete search history.

(56) References Cited

U.S. PATENT DOCUMENTS

| | | | | |
|---|---|---|---|---|
| 4,108,744 | A | 8/1978 | Bernat et al. | |
| 4,272,338 | A * | 6/1981 | Lynch et al. | 205/512 |
| 5,435,898 | A | 7/1995 | Commander et al. | |
| 6,869,519 | B2 * | 3/2005 | Koyama | 205/585 |
| 2003/0085130 | A1 | 5/2003 | Verberne et al. | |
| 2007/0256940 | A1 | 11/2007 | Schiffer et al. | |

FOREIGN PATENT DOCUMENTS

| | | | |
|---|---|---|---|
| CA | 2097868 | A1 | 12/1993 |
| DE | 19509575 | A1 | 9/1996 |
| DE | 10306823 | A1 | 9/2004 |
| DE | 10322120 | A1 | 12/2004 |

OTHER PUBLICATIONS

Abstract of DE10322120; Dec. 9, 2004.
Abstract of DE19509575; Sep. 19, 1996.
Abstract of DE10306823; Sep. 2, 2004.

* cited by examiner

*Primary Examiner* — Edna Wong
(74) *Attorney, Agent, or Firm* — Senniger Powers LLP

(57) ABSTRACT

The preceding invention concerns a galvanic bath as well as a method for depositing a zinc-bearing layer onto a substrate surface. According to the invention, it is provided that the galvanic bath be divided into at least two cell chambers, in which the division occurs by means of a cation-exchange membrane and one cell chamber includes an acidic deposition-electrolyte and the other cell chamber includes a neutral or acidic anolyte. The acidic anolyte here is at least partially removed from the cell chamber containing it and is stripped of the foreign metal ions contained in it by means of a cation-exchange arrangement.

11 Claims, 2 Drawing Sheets

GALVANIC BATH AND PROCESS FOR DEPOSITING ZINC-BASED LAYERS

REFERENCE TO RELATED APPLICATION

This application claims priority to German application 10 2008 056 776.0, filed Nov. 11, 2008.

FIELD OF THE INVENTION

The present invention concerns a galvanic bath as well as a method for depositing zinc-bearing layers onto substrate surfaces. In particular, the present invention concerns a galvanic bath as well as a method for depositing zinc-bearing layers from an acidic deposition-electrolyte.

BACKGROUND OF THE INVENTION

The deposition of zinc-bearing layers onto substrate surfaces finds widespread application in many areas of engineering. Zinc-bearing layers are particularly distinguished by their high corrosion resistance. Due to the appearance of the zinc coatings obtained, zinc layers or zinc-bearing layers are used less in the area of decorative coatings, but rather in the area of functional coatings. So, for example, it is common to coat small parts such as, for example, screws, nuts, and base washers, and pre-assembled structural elements such as angle iron or connecting plates and the like in large numbers. To do this, multiple small parts are dipped into appropriate deposition baths in so-called drum baskets and a deposition current is applied between the deposition basket and an anode.

Often another metal is deposited underneath the zinc, which may affect the properties obtained for the zinc-bearing layer deposited. In particular, the appearance, the corrosion resistance, and the mechanical properties of the layers deposited are influenced by appropriate alloy coatings. So, for example, zinc-manganese alloys for deposition are known from DE 103 06 823 A1. The galvanic deposition of zinc-nickel alloys is described in De 101 46 559.

Iron, cobalt, and nickel as alloy metals are known from DE 195 38 419 A1 for deposition together underneath zinc.

One problem with the galvanic deposition of zinc-bearing layers onto substrate surfaces from an acidic zinc-bearing electrolyte is that it takes place using zinc anodes which are depleted to form coatings on the anode surface, which these passivate and affect the production cycle detrimentally. The effectiveness of the galvanic deposition can also be reduced by these coatings.

SUMMARY OF THE INVENTION

One of the tasks of the present invention is also to avoid effects known as cementation. In addition, it is the task of the present invention to generally improve the method known from prior art for depositing zinc-bearing layers onto substrate surfaces.

This problem is resolved by means of a galvanic bath for depositing a zinc-bearing layer onto a substrate surface, exhibiting a first cell chamber, which includes an acidic deposition electrolyte, as well as a second cell chamber which includes a neutral or acidic anolyte, in which the first cell chamber is separated from the second cell chamber by a membrane permeable to cations and in which a zinc anode is disposed in the cell chamber including the anolyte, which is characterized by the fact that the cell chamber including the anolyte is hydraulically connected to an arrangement which replaces any foreign metal ions contained in the anolyte with zinc ions and/or protons.

With regard to the method, the problem is resolved by means of a method for galvanic deposition of a zinc-bearing layer onto a substrate surface in which the substrate to be coated is brought into contact in a galvanic bath with an acidic deposition-electrolyte containing at least zinc ions and a current is applied between the substrate and at least one anode, which current is suitable for inducing the deposition of a zinc-bearing layer onto the substrate surface, in which the galvanic bath is divided into at least two cells and the cells are separated from one another by a membrane permeable to cations, in which one cell includes the acidic deposition-electrolyte and the second cell a neutral or acidic zinc-ion-bearing anolyte and in which an anode to be depleted in zinc is disposed in the cell containing the anolyte, which is characterized by the fact that the acidic anolyte is at least partially removed from the cell chamber containing it and is directed through an arrangement in which any foreign metal ions are replaced by zinc ions and/or protons.

Surprisingly, it has been established that the division of a galvanic bath into a chamber including the deposition electrolyte and an anolyte chamber, which are separated from one another by a cation-exchange membrane, is suitable for overcoming problems known from prior art, provided that at least a partial stream of the anolyte is diverted and is directed through an arrangement in which any foreign metal ions are replaced by zinc ions and/or protons.

According to the invention, the arrangement in which any foreign metal ions contained in the anolyte are replaced can be, for example, a precipitant or a cation exchanger. In the case of a precipitant, the pH of the anolyte, for example, is raised to a value at which any foreign metal ions contained in the anolyte break down as hydroxides. The precipitate resulting thereby can be separated by means of sedimentation, filtration, centrifuging, or the like, and the anolyte thus stripped of any foreign metal ions returns again into the cell chamber including the anode. Before returning, the pH is again set to an appropriate acidic pH value by the addition of an acid. As a result of this, foreign metal ions are ultimately replaced by protons.

In a preferred embodiment of the invention, the arrangement in which any foreign metal ions contained in the anolyte are replaced by other cations is a cation exchanger which exhibits, for example, a suitable cation-exchange resin. The foreign metal ions are hereby preferentially replaced by other cations without anions entering the anolyte. Preferably, the foreign metal ions can hereby be replaced by protons or zinc ions.

In the galvanic bath according to the invention, the membrane permeable to cations serves to do this, to hold back a majority of the foreign metal ions contained in the deposition electrolyte, such as, for example, ions also being co-deposited from the group consisting of nickel, cobalt, manganese, or iron, although the membrane essentially is also permeable to these ions. Without being bound to this theory, the applicant assumes from this that the voltage drop of about 1 V that appears at the membrane represents a barrier which is overcome only with difficulty for the foreign metal ions contained in the deposition electrolyte. Nevertheless, the foreign metal ions migrating into the anolyte are caught by the arrangement provided according to the invention for replacing foreign metal ions and are preferentially replaced by zinc ions and/or protons. The arrangement here does not serve just to catch any foreign metal ions contained in the anolyte but also to maintain a specific zinc-ion level in the anolyte.

In an embodiment of the galvanic bath according to the invention, the anolyte exhibits an acid and/or alkali ions in addition to the zinc ions. Suitable acids in the anolyte can be, for example, boric acid, acetic acid, citric acid, tartaric acid, aminoacetic acid, methanesulfonic acid, hydrochloric acid, sulfuric acid, and the like. Suitable sources for zinc ions in the anolyte can be soluble zinc compounds such as, for example, zinc chloride, or zinc sulfate, or also organic zinc compounds such as zinc methanesulfonate, for example. Suitable sources for alkali ions can, for instance, be alkali salts such as sodium fluoride, sodium chloride, sodium bromide, lithium chloride, lithium fluoride, potassium chloride, potassium fluoride, potassium bromide, and the like.

Suitable membranes for separating the cell chambers are, according to the invention, cation-exchange membranes which are permeable to bivalent cations, such as, for instance, perfluorided membranes. Furthermore, microporous membranes such as, for example, dialysis membranes are suitable for use in the galvanic bath according to the invention.

In the embodiment of the invention in which additional metals such as nickel, cobalt, manganese, or iron, for instance, are deposited in addition to zinc, another anode is to be provided in the cell chamber containing the acidic deposition-electrolyte, which anode consists, for instance, of the metal being co-deposited.

In a particular embodiment of the invention, these two anodes can also be connected electrically to the substrate as the zinc anode disposed in the cell chamber containing the anolyte, by means of a single rectifier. Setting the deposition ratio between zinc and the additional metal being deposited is done according to the invention by varying the anolyte composition. In particular, the variation in alkali metal concentration is important here because this has a considerable influence on the conductivity of the anolyte and thus on its electrical resistance. As a result, additional rectifiers can thereby be preferably done away with, which leads to a clear cost reduction relative to the construction of the arrangement.

In a further embodiment of the invention, several separate cell chambers can be provided in the galvanic bath for holding the anolyte, each of which is fitted with a zinc anode. The individual anolyte chambers are connected hydraulically to one another, so that exchange of the anolyte is possible between the individual anolyte chambers. In a further development of this embodiment, the anolyte in a first anolyte chamber is removed at the same time, passes the arrangement for exchanging any foreign metal ions contained in the anolyte, and returns from it to the anolyte chamber most distant from the first anolyte chamber. More preferably, only one single arrangement is provided thereby for the exchange of foreign metal ions.

In the arrangement provided according to the invention for exchange of any foreign metal ions, an ion-exchange resin can be provided to replace foreign metal ions by zinc ions and/or protons. Suitable cation exchangers are, for example, slightly acidic, macroporous resins with chelate-forming iminodiacetic acid groups which selectively bind heavy metal cations. When selecting the ion-exchange resin, it must be ensured that it has sufficient selectivity to exchange bivalent cations and be essentially neutral compared to monovalent cations. Cation-exchange resins are customarily conditioned and loaded with zinc ions by means of a zinc-ion-bearing solution such as a zinc-chloride solution, for example. When the anolyte flows through the cation-exchange arrangement, then any foreign metal ions contained in the anolyte are taken up by the cation-exchange resin and replaced by zinc ions. On the one hand, long-lasting contamination of the anolyte with foreign metal ions is thereby avoided; on the other hand, the cation-exchange arrangement functions as a type of zinc-ion buffer, whereby the zinc-ion level in the anolyte can be held at a desired level.

In a further embodiment of the invention, it can be provided that the replacement of any foreign metal ions contained in the anolyte by zinc ions and/or protons is already taking place in the cell chamber containing the anolyte. For this, a liquid-permeable pouch or hollow body filled with an appropriate ion-exchange resin can be provided, for example, in the cell chamber containing the anolyte. As a result, which is more preferable, arrangements such as pumps or the like for supplying the anolyte can be done away with.

DETAILED DESCRIPTION OF PREFERRED EMBODIMENTS

This application claims priority to German application 10 2008 056 776.0, filed Nov. 11, 2008, the entire disclosure of which is incorporated by reference.

Figure 1:
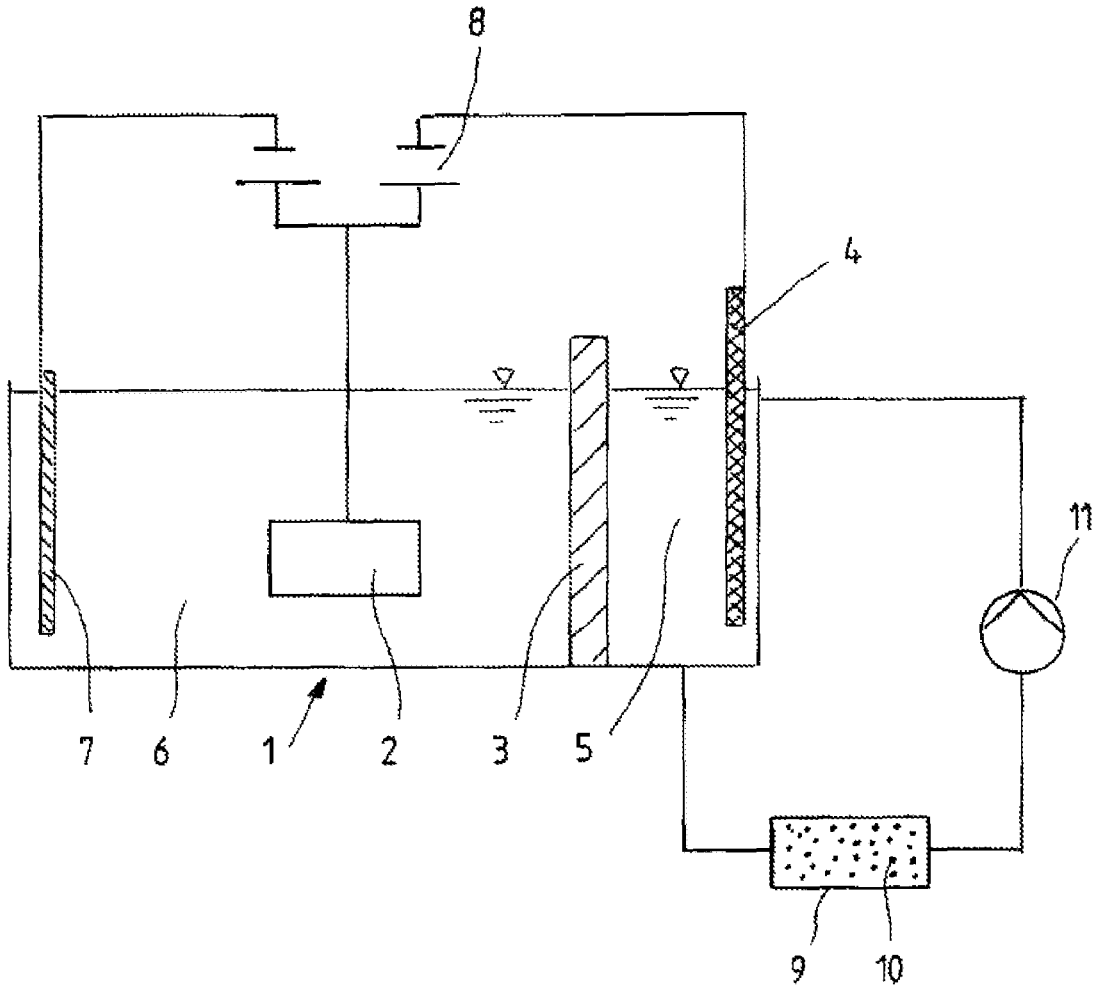
FIG. 1 shows a schematic representation of a galvanic bath according to the invention.

FIG. 1 shows an embodiment of a galvanic bath 1 according to the invention in which is disposed a substrate 2 to be coated, whereby the galvanic bath 1 is divided up by means of a cation-exchange membrane 3 into one cell chamber 5 and one cell chamber 6, in which the cell chamber 5 includes a neutral or acidic anolyte and the cell chamber 6 the deposition electrolyte. A zinc anode 4 to be depleted is disposed in the cell chamber 5. In the case of the co-deposition of additional metals such as nickel, cobalt, manganese, or iron, a second anode 7 is provided in the cell chamber 6, which consists of the metal to be co-deposited and is also preferably arranged so as to be depleted. The anode 4, and in the case of the co-deposition of additional metals, the anode 7 as well, are in electrical contact through a rectifier 8 with the substrate 2. By applying a suitable deposition current, the metal ions from the deposition electrolyte are now deposited onto the substrate 2. To the extent that zinc ions are deposited, zinc ions from the zinc electrode 4 are dissolved and diffuse out of the cell chamber 5 through the cation-exchange membrane 3 into the cell chamber 6. As a result of this, the zinc level in the cell chamber 6 is kept constant. A potential drop of about 1 Volt exists at the cation-exchange membrane 3, by way of the deposition voltage applied, whereby further foreign metal ions contained in the deposition electrolyte, such as nickel, cobalt, manganese, or iron ions, for example, are essentially prevented from passing through the cation-exchange membrane 3 in the cell chamber 5. Because passage of these foreign metal ions through the cation-exchange membrane 3 cannot, however, be entirely avoided, a certain foreign-metal concentration is to be expected in cell chamber 5, especially when the deposition voltage is shut off and no potential drop can be applied any longer to the cation-exchange membrane 3 which impedes passage of the foreign metal ions. In order to avoid the cementation effects caused by these foreign metal ions at the anode 4, the anolyte contained in cell chamber 5 is at least partially removed from cell chamber 5 by means of suitable supply arrangements such as, for instance, a pump 11 and is directed through a cation-exchange arrangement 9 before it returns to cell chamber 5. The cation-exchange arrangement 9 is filled with a cation-exchange resin 10 which is loaded with zinc ions in a upstream conditioning step. The foreign ions contained in the anolyte are now resorbed into the cation-exchange arrangement 9 at the cation-exchange resin 10 and replaced by zinc ions.

Figure 2:
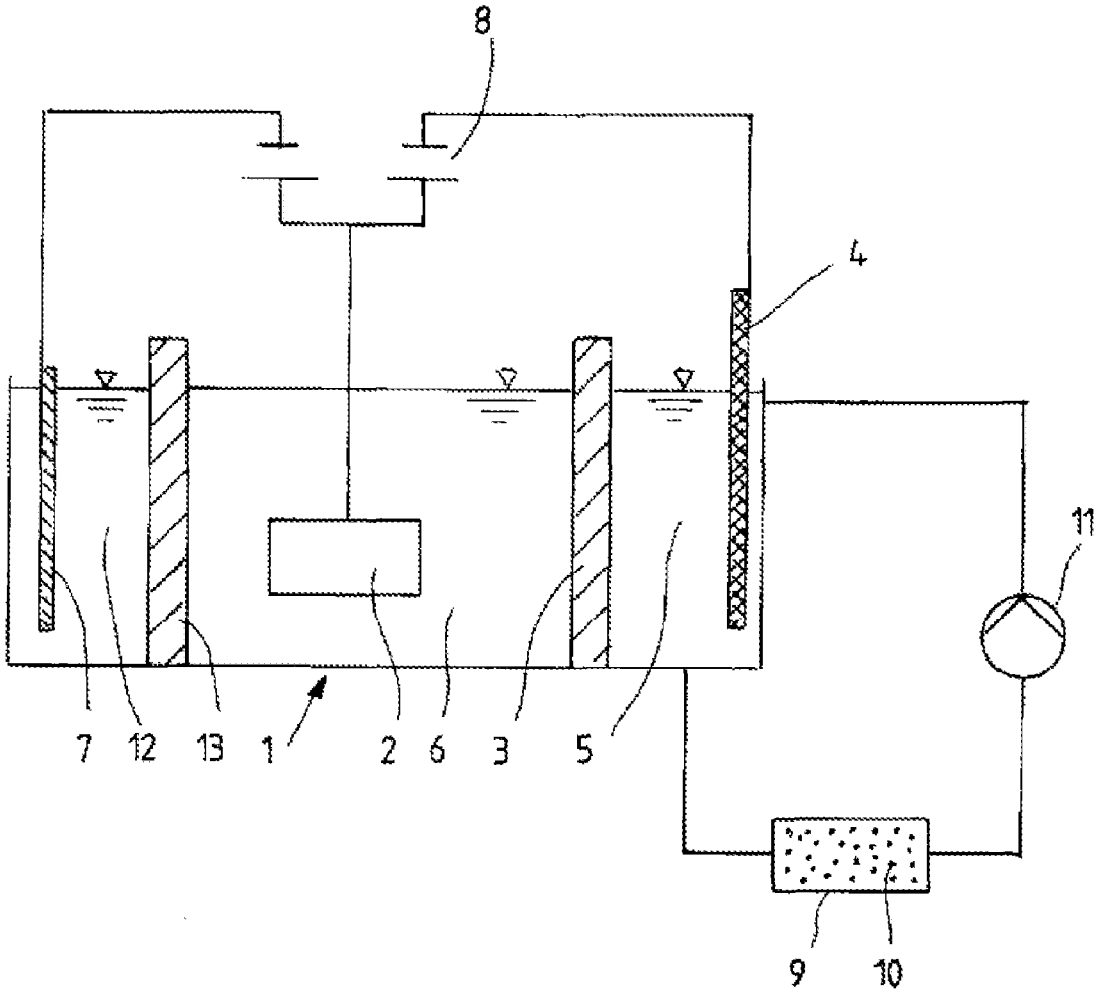
FIG. 2 shows a schematic representation of a galvanic bath according to the invention in a further embodiment for the deposition of zinc-manganese layers.

FIG. 2 shows an embodiment of the galvanic bath 1 according to the invention in which a second cell chamber 12 below cell chamber 6 is separated from cell chamber 5 by means of a cation-exchange membrane 13. Cell chamber 12 here includes an additional anolyte such as a manganese-bearing anolyte, for instance, as well as a foreign metal anode 7, which can be formed from electrolytic manganese, for example, included in a titanium basket. The anolyte in cell chamber 12 presents a source of manganese ions such as manganese (II) sulfate and is set, by means of a suitable acid such as, for example, sulfuric acid, to a pH less than 2. By applying a voltage between the anodes 4 and 7 and the substrate 2, manganese ions are given up, under current flow, through the cation-exchange membrane 13 to the deposition electrolyte.

The invention is clarified below by embodiment examples, without the invention, however, being restricted to these embodiment examples.

EXAMPLE 1

Deposition of a Zinc-Nickel Layer

In a galvanic bath according to the invention, as is reproduced in FIG. 1, a deposition electrolyte is introduced into the cell chamber 6, which contains 40-100 g/l of zinc chloride, 60-130 g/l of nickel chloride hexahydrate, 140-220 g/l of potassium chloride, 10-30 g/l of boric acid, 25 g/l of sodium acetate trihydrate, 30 g/l of aminoacetic acid, 2-12 g/l of sodium saccharine, 0.025-0.20 g/l of benzalacetone, 0.006-0.01 g/l of orthochlorobenzaldehyde, 0.8-1.2 g/l of octanolethoxylate, and 2.5-3.2 g/l of a potassium salt of sulfopropylated, polyalkoxylated naphthol. The pH of the electrolyte composition described here lies between 5 and 6.

Into the cell chamber 5 is filled an anolyte which includes 120 g/l of zinc chloride, 215 g/l of potassium chloride, and 20 g/l of boric acid. But the concentration of the components contained in the anolyte can be varied within the ranges of 80 and 500 g/l for zinc chloride, 150 to 300 g/l for potassium chloride, and 15 to 25 g/l for boric acid, whereby the deposition ratio of zinc to nickel onto the substrate surface can be influenced.

A zinc anode, to be depleted, is disposed in the cell chamber 5, whereas a nickel anode to be depleted is disposed in cell chamber 6. Screws, as the substrate to be coated, are placed in a galvanizing drum in which the cathodic contact occurs across centrally disposed contact studs. At a deposition-electrolyte temperature of 25° to 50° C. and a pH of 5 to 6 for the deposition electrolyte, and with a cathodic current density of 0.1 to 1.5 A/dm$^2$, a zinc-nickel layer is deposited on the screws serving as the substrate, at a deposition rate up to about 0.4 μm per minute.

EXAMPLE 2

Deposition of a Zinc-Nickel Layer

In a galvanic bath according to the invention, as is reproduced in FIG. 1, a deposition electrolyte is introduced into the cell chamber 6, which contains 40-100 g/l of zinc chloride, 60-130 g/l of nickel chloride hexahydrate, 140-220 g/l of potassium chloride, 10-30 g/l of boric acid, 25 g/l of sodium acetate trihydrate, 30 g/l of aminoacetic acid, 2-12 g/l of sodium saccharine, 0.025-0.20 g/l of benzalacetone, 0.006-0.01 g/l of orthochlorobenzaldehyde, 0.8-1.2 g/l of octanolethoxylate, and 2.5-3.2 g/l of a potassium salt of sulfopropylated, polyalkoxylated naphthol. The pH of the electrolyte composition described here lies between 5 and 6.

Into the cell chamber 5 is filled an anolyte which includes 120 g/l of zinc chloride, 215 g/l of potassium chloride, and 20 g/l of boric acid. But the concentration of the components contained in the anolyte can be varied within the ranges of 80 and 500 g/l for zinc chloride, 150 to 300 g/l for potassium chloride, and 15 to 25 g/l for boric acid, whereby the deposition ratio of zinc to nickel onto the substrate surface can be influenced.

Zinc pellets to be depleted are disposed in cell chamber 5 in an anode basket made of titanium, whereas a nickel anode to be depleted is disposed in cell chamber 6. Cast parts, as the substrate to be coated, are put up on largely isolated racks, where the cathodic contact occurs across the metal points on the rack. At a deposition-electrolyte temperature of 25° to 50° C. and a pH of 5 to 6 for the deposition electrolyte, and with a cathodic current density of 0.1 to 4 A/dm$^2$, a zinc-nickel layer is deposited on the screws serving as the substrate, at a deposition rate up to 1 μm per minute.

EXAMPLE 3

Deposition of a Zinc-Cobalt Layer

In a galvanic bath according to the invention, as is reproduced in FIG. 1, a deposition electrolyte is introduced into the cell chamber 6, which contains 60-70 g/l of zinc chloride, 100-130 g/l of cobalt chloride hexahydrate, 190-220 g/l of potassium chloride, 15-20 g/l of boric acid, 25 g/l of sodium acetate trihydrate, 30 g/l of aminoacetic acid, 2-12 g/l of sodium saccharine, 0.025-0.20 g/l of benzalacetone, 0.006-0.01 g/l of orthochlorobenzaldehyde, and 2.5-3.2 g/l of a potassium salt of sulfopropylated, polyalkoxylated naphthol. The pH of the electrolyte composition described here lies between 5 and 6.

An anolyte which consists of 250 g/l of zinc chloride, is contained in cell chamber 5. But the concentration of the zinc chloride contained in the anolyte can be varied within the range of 80 to 500 g/l of zinc chloride. Zinc pellets to be depleted are disposed in cell chamber 5 in an anode basket made of titanium, whereas a cobalt anode to be depleted is disposed in cell chamber 6. Screws, as the substrate to be coated, are placed in a galvanizing drum in which the cathodic contact occurs across contact studs. At a deposition-electrolyte temperature of 25° to 50° C. and a pH of 5.3 to 5.6 for the deposition electrolyte, and with a cathodic current density of 0.2 to 4 A/dm$^2$, a zinc-cobalt layer is deposited on the screws serving as the substrate at a deposition rate up to about 1 μm per minute.

EXAMPLE 4

Deposition of a Bright Zinc Layer

In a galvanic bath according to the invention, as is reproduced in FIG. 1, a deposition electrolyte is introduced into the cell chamber 6, which contains 40-90 g/l of zinc chloride, 180-230 g/l of potassium chloride, 20-30 g/l of boric acid, 0.025-0.20 g/l of benzalacetone, 0.8-1.2 g/l of octanolethoxylate, and 2.5-3.2 g/l of a potassium salt of sulfopropylated, polyalkoxylated naphthol. The pH of the electrolyte composition described here lies between 5 and 6.

An anolyte, which consists of 250 g/l of zinc chloride and 220 g/l of potassium chloride, is contained in cell chamber 5. But the concentration of the zinc chloride contained in the anolyte can be varied within the range of 80 to 500 g/l of zinc chloride. Potassium chloride can be used in a concentration of 10 to 300 g/l. Zinc pellets to be depleted are disposed in cell chamber 5 in an anode basket made of titanium. Screws, as the substrate to be coated, are placed in a galvanizing drum in which the cathodic contact occurs across contact studs. At a deposition-electrolyte temperature of 25° to 50° C. and a pH of 5.3 to 5.6 for the deposition electrolyte, and with a cathodic current density of 0.1 to 2 A/dm$^2$, a zinc layer is deposited on the screws serving as the substrate, at a deposition rate up to about 0.5 μm per minute.

EXAMPLE 5

Deposition of a Zinc-Manganese Layer

In a galvanic bath according to the invention, as is reproduced in FIG. 2, a deposition electrolyte is introduced into cell chamber 6, which contains 40-62 g/l of bivalent zinc, 80-110 g/l of bivalent manganese, 190-220 g/l of a conducting salts, 30-100 g/l of a buffer, 10-15 g/l of a wetting agent, 0.1-0.6 g/l of an antifoaming agent, 0-10 g/l of an antioxidant, and 0-1 g/l of a brightening agent.

An anolyte, which consists of 250 g/l of zinc chloride and 220 g/l of potassium chloride, is contained in cell chamber 5. But the concentration of the zinc chloride contained in the anolyte can be varied within the range of 80 to 500 g/l of zinc chloride. Potassium chloride can be used in a concentration of 10 to 300 g/l. A zinc plate to be depleted is disposed in cell chamber 5.

In the third cell chamber 12, which has no connection with the cation-exchange arrangement 12 and which is separated from cell chamber 6 by a cation-exchange membrane 13, is contained an anolyte which includes 150 g/l of manganese (II) sulfate and 30 g/l of sulfuric acid. But the concentration of the manganese (II) sulfate contained in this anolyte can be varied within a range of 50 to 250 g/l of manganese (II) sulfate. The amount of sulfuric acid used initially, 30 g/l, is made up during use so that the pH remains below 2. Crushed electrolytic manganese in a titanium anode basket is used as an electrical supply.

Screws, as the substrate to be coated, are placed in a galvanizing drum in which the cathodic contact occurs across contact pins. At a deposition-electrolyte temperature of 25° to 50° C. and a pH of 5 to 6 for the deposition electrolyte, and with a cathodic current density of 0.2 to 2 A/dm$^2$, a zinc layer is deposited on the screws serving as the substrate, at a deposition rate up to about 0.5 μm per minute.

REFERENCE LIST

1 Galvanic bath
2 Substrate
3 Cation-exchange membrane
4 Zinc anode
5 Cell chamber for anolyte
6 Cell chamber for deposition electrolyte
7 Foreign metal anode
8 Rectifier
9 Cation-exchange arrangement
10 Cation-exchange resin
11 Pump
12 Additional cell chamber
13 Additional cation-exchange membrane

The invention claimed is:

1. A method for galvanic deposition of a zinc-bearing layer onto a substrate surface comprising:

contacting the substrate surface in a galvanic bath with an acidic deposition-electrolyte comprising zinc ions;

applying a current between the substrate and at least one anode suitable to deposit the zinc-bearing layer onto the substrate surface, wherein the galvanic bath is divided into at least a first cell comprising the acidic deposition-electrolyte and a second cell comprising a neutral or acidic zinc-bearing anolyte and the at least one anode comprising a zinc anode to be depleted, and wherein the first cell and second cell are separated by a membrane permeable to cations;

removing at least a portion of the neutral or acidic zinc-bearing anolyte from the second cell; and directing at least a portion of the neutral or acidic zinc-bearing anolyte removed from the second cell through an arrangement wherein at least a portion of any foreign metal ions are replaced by zinc ions and/or protons.

2. A method according to claim 1 wherein the first cell further comprises a first cell anode to be depleted and serves as a source for an additional metal to be deposited onto the substrate surface together with zinc.

3. A method according to claim 2 wherein the zinc anode and the first cell anode are in electrical contact across a mutual rectifier with the substrate and wherein the neutral or acidic zinc-bearing anolyte comprises alkali metal ions and the deposition ratio of zinc and the additional metal to be deposited is influenced by the concentration of the alkali metal ions in the neutral or acidic zinc-bearing anolyte.

4. The method according to claim 1 wherein the neutral or acidic zinc-bearing anolyte has between 80 and 500 g/l of zinc chloride.

5. The method according to claim 1 wherein the neutral or acidic zinc-bearing anolyte has between 150 to 300 g/l of an alkali halide.

6. The method of claim 1 wherein the neutral or acidic zinc-bearing anolyte has between 10 and 30 g/l of an acid.

7. The method of claim 1 wherein the acidic deposition-electrolyte further comprises ions of at least one metal selected from the group consisting of nickel, cobalt, manganese, and iron.

8. The method according to claim 1 wherein the membrane permeable to cations is a cation-exchange membrane or a microporous membrane.

9. The method according to claim 1 wherein the arrangement for replacing any foreign metal ions contained in the neutral or acidic zinc-bearing anolyte with the zinc ions and/or protons is a precipitant or an ion-exchange arrangement.

10. The method according to claim 1 wherein the galvanic bath comprises several cells comprising neutral or acidic zinc-bearing anolyte, each of which is separated from the first cell comprising the acidic deposition electrolyte by a membrane permeable to cations, and wherein the plurality of cells comprising neutral or acidic zinc-bearing anolyte are hydraulically connected to one another.

11. The method according to claim 1 wherein the galvanic bath further comprises at least one additional cell comprising an anolyte comprising ions of an additional metal to be deposited with zinc on the substrate surface and an additional metal anode, to be depleted, of the additional metal, wherein the at least one additional cell is separated from the first cell comprising the acidic deposition-electrolyte by a cation-exchange membrane.

* * * * *